US005255569A

United States Patent [19]

Terauchi et al.

[11] Patent Number: 5,255,569

[45] Date of Patent: Oct. 26, 1993

[54] SLANT PLATE TYPE COMPRESSOR WITH VARIABLE DISPLACEMENT MECHANISM

[75] Inventors: Kiyoshi Terauchi, Isesaki; Shigemi Shimizu, Sawa, both of Japan

[73] Assignee: Sanden Corporation, Gunma, Japan

[21] Appl. No.: 806,291

[22] Filed: Dec. 13, 1991

[30] Foreign Application Priority Data

Dec. 15, 1990 [JP] Japan ..... 2-403384[U]

[51] Int. Cl.[5] ..... F04B 1/26

[52] U.S. Cl. ..... 74/60; 91/505

[58] Field of Search ..... 74/60; 417/222 R, 222 S, 417/269; 91/505

[56] References Cited

U.S. PATENT DOCUMENTS

| | | | |
|---|---|---|---|
| 2,633,104 | 3/1953 | Lauck et al. | 91/505 |
| 3,010,403 | 11/1961 | Zubaty | 103/150 |
| 3,861,829 | 1/1975 | Roberts et al. | 417/53 |
| 4,011,029 | 3/1977 | Shimizu | 417/269 |
| 4,037,993 | 7/1977 | Roberts | 417/222 |
| 4,145,163 | 3/1979 | Fogelberg et al. | 417/222 |
| 4,174,191 | 11/1979 | Roberts | 417/222 |
| 4,428,718 | 1/1984 | Skinner | 417/222 |
| 4,475,871 | 10/1984 | Roberts | 417/222 |
| 4,480,964 | 11/1984 | Skinner | 417/222 |
| 4,506,648 | 3/1985 | Roberts | 123/564 |
| 4,533,299 | 8/1985 | Swain et al. | 417/222 |
| 4,543,043 | 9/1985 | Roberts | 417/222 |
| 4,576,554 | 3/1986 | Wagenseil et al. | 417/270 |
| 4,586,874 | 5/1986 | Hiraga et al. | 417/222 |
| 4,606,705 | 8/1986 | Parekh | 417/222 |
| 4,632,640 | 12/1985 | Terauchi | 417/269 |
| 4,732,544 | 3/1988 | Kurosawa et al. | 417/222 |
| 4,846,049 | 7/1989 | Terauchi | 92/12.2 |
| 4,850,811 | 7/1989 | Takai | 417/222 |
| 4,880,360 | 11/1989 | Terauchi et al. | 417/222 |
| 4,948,343 | 8/1990 | Shimizu | 417/222 |
| 4,960,366 | 10/1990 | Higuchi | 417/222 |
| 4,960,367 | 10/1990 | Terauchi | 417/222 |
| 4,973,229 | 11/1990 | Oono et al. | 417/222 R |
| 4,990,063 | 2/1991 | Oono et al. | 417/222 R |
| 5,056,416 | 10/1991 | Ota et al. | 91/505 X |
| 5,094,590 | 3/1992 | Carella et al. | 417/222 S |

FOREIGN PATENT DOCUMENTS

| | | |
|---|---|---|
| 0090486 | 10/1983 | European Pat. Off. . |
| 0292288 | 11/1988 | European Pat. Off. . |
| 3545581 | 7/1986 | Fed. Rep. of Germany . |
| 3603931 | 8/1986 | Fed. Rep. of Germany . |
| 60-162087 | 8/1985 | Japan . |
| 61-261681 | 11/1986 | Japan . |
| 62-55478 | 3/1987 | Japan . |
| 1-142277 | 6/1989 | Japan . |
| 530595 | 12/1940 | United Kingdom . |
| 865876 | 4/1961 | United Kingdom . |
| 964000 | 7/1964 | United Kingdom . |
| 1436390 | 5/1976 | United Kingdom . |
| 2153922 | 8/1985 | United Kingdom . |
| 2155116 | 9/1985 | United Kingdom . |

*Primary Examiner*—Leslie A. Braun
*Assistant Examiner*—Andrea Pitts
*Attorney, Agent, or Firm*—Baker & Botts

[57] ABSTRACT

A slant plate type compressor with a variable displacement mechanism is disclosed. The compressor includes a drive mechanism having a drive shaft rotatably supported in a compressor housing and a coupling mechanism for drivingly coupling the drive shaft to pistons such that rotary motion of the drive shaft is converted into reciprocating motion of the pistons. The coupling mechanism includes a slant plate having an inclined surface. The slant angle changes in response to a change in pressure in the crank chamber and, thus, changes the capacity of the compressor. The drive shaft includes an inner end portion which has a diameter that is smaller than a diameter of the remainder of the drive shaft. A bias spring which has an outer diameter that is greater than a diameter of the remainder of the drive shaft is resiliently mounted on the inner end portion of the drive shaft between the slant plate and the cylinder block. The bias spring restores the slant plate back to its maximum slant angle when the slant angle is decreased below a predetermined angle without the bias spring interfering with the free pivoting motion of the slant plate between various inclination angles. Thereby, the impact forces which act on the internal component parts of the compressor when the compressor is started can be reduced, while at the same time the bias spring still can sufficiently urge the slant plate toward its maximum slant angle if the slant angle decreases below the predetermined slant angle.

12 Claims, 4 Drawing Sheets

SLANT PLATE TYPE COMPRESSOR WITH VARIABLE DISPLACEMENT MECHANISM

BACKGROUND OF THE INVENTION

1. Field of the Invention

The present invention generally relates to a refrigerant compressor and, more particularly, to a slant plate type compressor, such as a wobble plate type compressor, with a variable displacement mechanism suitable for use in an automotive air conditioning system.

2. Description of the Prior Art

A wobble plate type compressor with a variable displacement mechanism suitable for use in an automotive air conditioning system is disclosed in U.S. Pat. No. 4,960,366 to Higuchi, the disclosure of which is hereby incorporated by reference. As disclosed therein, the compression ratio of the compressor may be controlled by changing the slant angle of the inclined surface of the wobble plate. The slant angle of the inclined surface of the wobble plate and the slant plate on which it is disposed changes in response to a change in the crank chamber pressure relative to the suction chamber pressure. Changes in the crank chamber pressure are generated by a valve control mechanism which controls communication between the suction chamber and the crank chamber.

The relevant part of the above-mentioned wobble plate type compressor is shown in FIGS. 1-3. Drive shaft 260 includes inner end portion 260*a* and intermediate portion 260*b*. Inner end portion 260*a* is rotatably supported by cylinder block 21 through bearing 31. The diameter of inner end portion 260*a* is smaller than the diameter of intermediate portion 260*b*. Tapered ridge portion 260*c* is formed at the boundary between inner end portion 260*a* and intermediate portion 260*b* of integrally formed drive shaft 260.

Slant plate 50 includes opening 53 through which drive shaft 260 is disposed. Opening 53 of slant plate 50 has a configuration as disclosed in U.S. Pat. No. 4,846,049 to Terauchi, the disclosure of which is hereby incorporated by reference. Wobble plate 60 is nutatably mounted on hub 501 of slant plate 50 such that slant plate 50 rotates with respect to wobble plate 60. Balance weight ring 80 which has a substantial mass is disposed on a nose of hub 501 of slant plate 50 in order to balance slant plate 50 under dynamic operating conditions. Annular groove 502 is formed at an outer peripheral surface of the nose of hub 501. Balance weight ring 80 is held in place by means of retaining ring 81 which is firmly fixed in annular groove 502.

Snap ring 330 is attached to inner end portion 260*a*, and is adjacent to intermediate portion 260*b*. Bias spring 340 is mounted on intermediate portion 260*b*, at a position between slant plate 50 and snap ring 330. One end (to the right in FIG. 1) of bias spring 340 is disposed about inner end portion 260*a*, adjacent to tapered ridge portion 260*c*. The inner diameter of the right end of bias spring 340 is smaller than the diameter of intermediate portion 260*b*. This right end of bias spring 340 is contained or sandwiched between tapered ridge portion 260*c* and snap ring 330. Accordingly, axial movement of bias spring 340 along drive shaft 260 is prevented.

Annular depression 503 is formed at a rearward (to the right in FIG. 1), radially inner peripheral region of hub 501 of slant plate 50 so as to be able to receive bias spring 340 therewithin. Pillared hollow portion 504, which has a crescent-shaped lateral cross section, is formed at a rear (to the right in FIG. 1) end surface of one peripheral region of hub 501 of slant plate 50. An axis of pillared hollow portion 504 diagonally intersects with an axis of annular depression 503 so that the rear end surface of one peripheral region of hub 501 of slant plate 50 is archedly cut out as shown in FIG. 2.

The non-tensioned length of bias spring 340 when no force acts thereon is selected such that the non-secured end of bias spring 340 does not contact any portion of the bottom surface of annular depression 503, so long as the slant angle of slant plate 50 is in a range between the maximum slant angle and a selected intermediate slant angle. However, slant plate 50 is urged towards the maximum slant angle by the restoring force of bias spring 340 if the slant angle of slant plate 50 decreases below the selected intermediate slant angle due to contact of the slant plate with the spring. When the slant angle of slant plate 50 is at a maximum, the compressor operates with maximum displacement.

In operation, when the compressor is started, impact forces which act on the internal component parts of the compressor are generated. The magnitude of the impact forces is proportional to the slant angle of slant plate 50. Since slant plate 50 will very likely stay at or close to the selected intermediate slant angle when the compressor is stopped, the intermediate slant angle is selected to be a small percentage of the maximum slant angle, that is, the non-tensioned length of bias spring 340 is selected to be small in order to reduce the magnitude of the impact forees which are generated when the compressor is restarted.

However, the vacant space between the drive shaft and annular depression 503 in which bias spring 340 is disposed, around intermediate portion 260*b*, is limited to a small region because the diameter of intermediate portion 260*b* of drive shaft 260 is large. Therefore, the diameter of the body of bias spring 340 is limited to a small value and, thus, the modulus of elasticity of bias spring 340 is limited to a small value because the diameter of the body of bias spring 340 raised to the fourth power is proportional to the modulus of elasticity of bias spring 340. Accordingly, if the slant angle of slant plate 50 decreases below the selected intermediate slant angle, the restoring force of bias spring 340 may not sufficiently urge slant plate 50 back towards the maximum slant angle.

Furthermore, pillared hollow portion 504 prevents bias spring 340 from interfering with hub 501 of slant plate 50 during the inclining motion of slant plate 50. However, the provision of pillared hollow portion 504 decreases the mechanical strength of hub 501 because the thickness of hub 501 is decreased in the one peripheral region where the hollow portion 504 is located.

SUMMARY OF THE INVENTION

Accordingly, it is an object of the present invention to provide a variable capacity slant plate type compressor having a bias spring secured to the drive shaft which can sufficiently urge the slant plate back toward its maximum slant angle if the slant angle of the slant plate decreases below a selected intermediate slant angle, while at the same time providing for a reduction of the impact forces acting on the internal component parts of the compressor at the time when the compressor is started.

It is another object of the present invention to provide a variable capacity slant plate type compressor having a bias spring secured to the drive shaft to urge the slant plate back towards its maximum slant angle without decreasing the strength of the hub of the slant plate, while at the same time eliminating any interference the bias spring may cause with the free pivoting motion of the slant plate between various inclination angles.

A slant plate compressor in accordance with the present invention includes a compressor housing having a cylinder block with a front end plate and a rear end plate attached thereto. The front end plate encloses a crank chamber within the cylinder block, and a plurality of cylinders are formed in the cylinder block. A piston is slidably fitted within each of the cylinders. A drive mechanism is coupled to the pistons to reciprocate the pistons within the cylinders. The drive mechanism includes a drive shaft rotatably supported in the compressor housing, a rotor coupled to the drive shaft and rotatable therewith, and a coupling mechanism for drivingly coupling the rotor to the pistons such that rotary motion of the rotor is converted into reciprocating motion of the pistons within the cylinders. The coupling mechanism includes a slant plate having a surface disposed at a slant angle relative to a plane perpendicular to the drive shaft. The capacity of the compressor is varied as the slant angle changes.

The rear end plate includes a suction chamber and a discharge chamber defined therein. A communication path through the cylinder block links the crank chamber with the suction chamber. A valve control mechanism controls the opening and closing of the communication path, thereby generating a change in the pressure in the crank chamber. The slant angle of the slant plate changes in response to changes in the crank chamber pressure relative to the suction chamber pressure.

The drive shaft includes an inner end portion which has a diameter that is smaller than a diameter of the remainder of the drive shaft. A bias spring, which has an outer diameter greater than the diameter of the remainder of the drive shaft, is resiliently mounted on the inner end portion of the drive shaft between the slant plate and the cylinder block. The bias spring restores the slant plate back to its maximum slant angle when the slant angle is decreased below a predetermined angle without interfering with the free pivoting motion of the slant plate between various inclination angles. Thereby, the impact forces which act on the internal component parts of the compressor at the time when the compressor is started can be reduced, while the bias spring can still sufficiently urge the slant plate toward the maximum slant angle if the slant angle decreases below a predetermined angle.

DETAILED DESCRIPTION OF THE PREFERRED EMBODIMENTS

Figure 1:
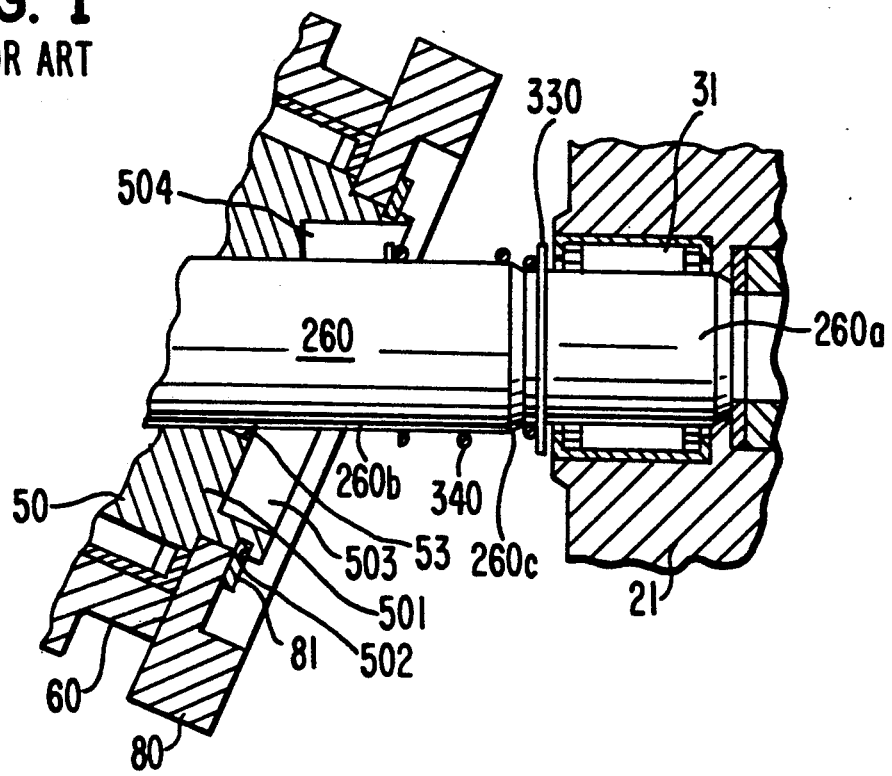
FIG. 1 PRIOR ART
FIG. 1 illustrates a fragmentary longitudinal sectional view of a prior art wobble plate type compressor.
Figure 2:
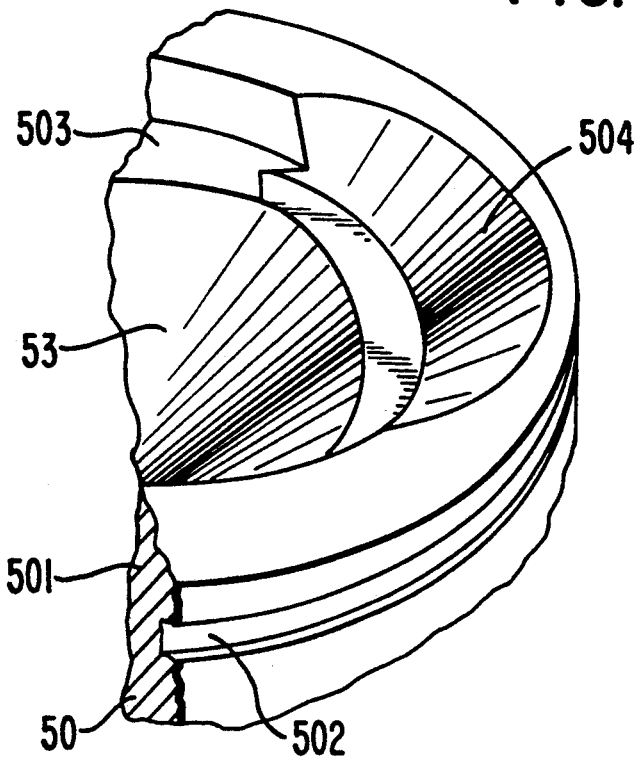
FIG. 2 illustrates an enlarged fragmentary perspective view of the slant plate shown in FIG. 1.
Figure 3:
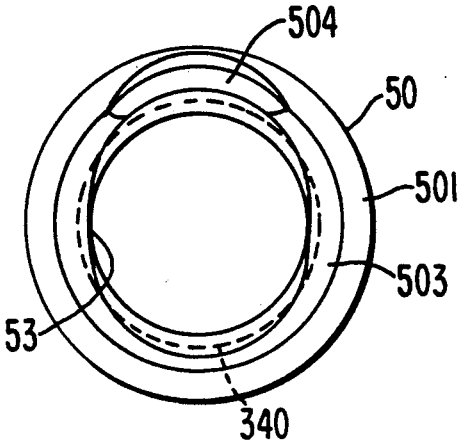
FIG. 3 PRIOR ART
FIG. 3 illustrates an enlarged side view of the slant plate shown in FIG. 1.

In all of FIGS. 4–8, identical reference numerals are used to denote elements which are identical to the similarly numbered elements shown in the prior art FIGS. 1–3. Additionally, although the present invention is described below in terms of a wobble plate type compressor, it is not limited in this respect. The present invention is broadly applicable to slant plate type compressors. Furthermore, for purposes of explanation only, the left side of FIGS. 4, 5, 7 and 8 will be referenced as the forward end or front and the right side of the drawings will be referenced as the rearward end or rear. The term "axial" refers to a direction parallel to the longitudinal axis of the drive shaft, and the term "radial" refers to the perpendicular direction. Of course, all of the reference directions are made for the sake of convenience of description and are not intended to limit the invention in any.

Figure 4:
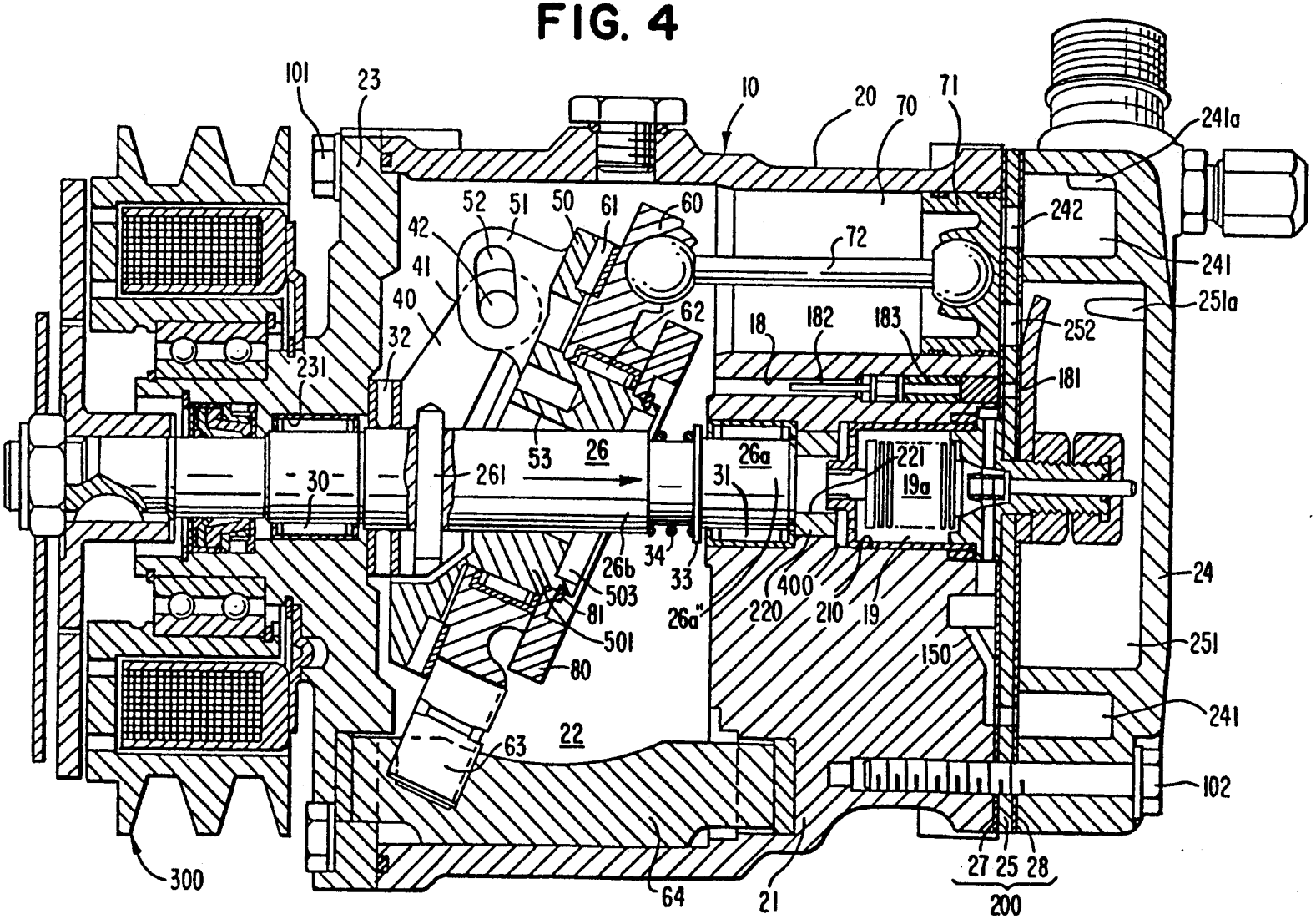
FIG. 4 illustrates a longitudinal sectional view of a wobble plate type compressor in accordance with a first embodiment of the present invention.

With reference to FIG. 4, compressor 10 includes cylindrical housing assembly 20 including cylinder block 21, front end plate 23 disposed at one end of cylinder block 21, crank chamber 22 enclosed within cylinder block 21 by front end plate 23, and rear end plate 24 attached to the other end of cylinder block 21. Front end plate 23 is secured to one end of cylinder block 21 by a plurality of bolts 101. Rear end plate 24 is secured to the opposite end of cylinder block 21 by a plurality of bolts 102. Valve plate 25 is disposed between rear end plate 24 and cylinder block 21. Opening 231 is centrally formed in front end plate 23 for supporting drive shaft 26. Drive shaft 26 is supported by bearing 30 disposed in opening 231.

Figure 5:
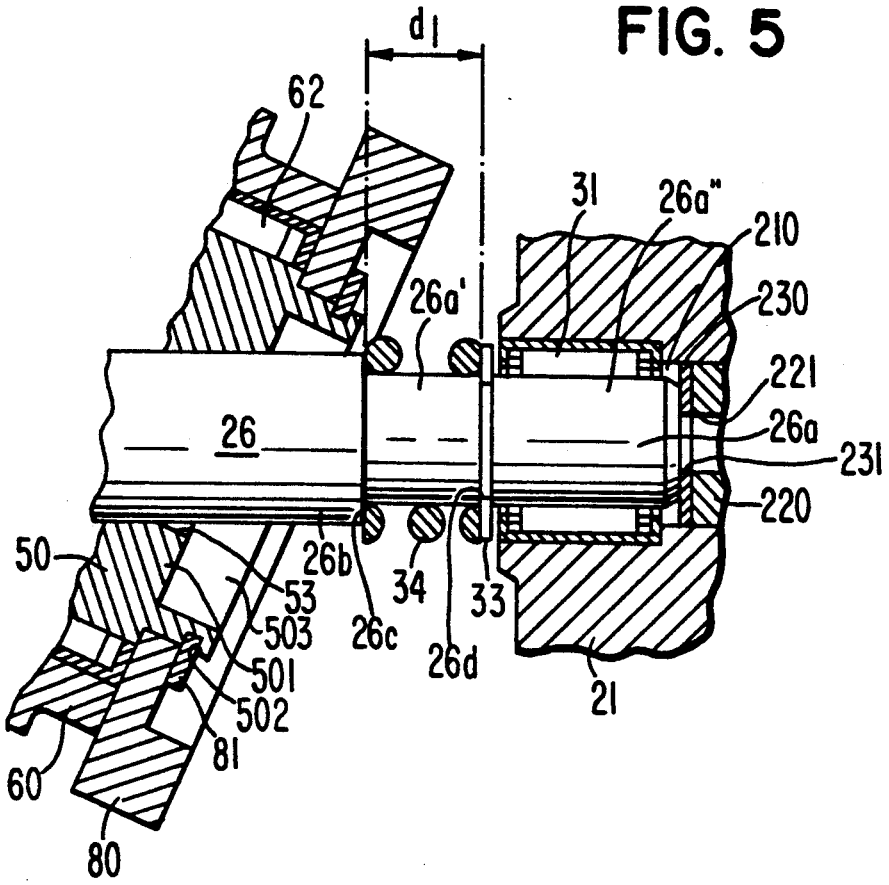
FIG. 5 illustrates an enlarged fragmentary longitudinal sectional view of the wobble plate type compressor shown in FIG. 4.

With additional reference to FIG. 5, drive shaft 26 includes inner end portion **26*a* and intermediate portion 26*b* which is adjacent to inner end portion 26*a*. The diameter of intermediate portion 26*b* is greater than the diameter of inner end portion 26*a*. Annular ridge 26*c* is formed at the boundary between inner end portion 26*a* and intermediate portion 26*b*. Annular ridge 26*c* is located to the right of slant plate 50. Snap ring 33 is firmly fixed in annular groove 26*d* formed at an outer peripheral surface of inner end portion 26*a*. Annular groove 26*d* is located at a position immediately to the left of the forward front surface of cylinder block 21. Inner end portion 26*a* of drive shaft 26 is divided into forward region 26*a*' and rearward region 26*a*'' by snap ring 33. Bias spring 34, which has an inner diameter slightly greater than the diameter of inner end portion 26*a* and is smaller than the diameter of intermediate portion 26*b*, is mounted on forward region 26*a*' of inner end portion 26*a* of drive shaft 26. Rearward region 26*a*'' of inner end portion 26*a* of drive shaft 26 is rotatably supported by bearing 31, disposed within central bore 210 of cylinder block 21**.

Bore 210 extends to a rear end surface of cylinder block 21 and houses valve control mechanism 19 which is described in detail in U.S. Pat. No. 4,960,367 to Terauchi, the disclosure of which is hereby incorporated by reference. Bore 210 includes a threaded portion (not shown) formed at an inner peripheral surface of a central region thereof. Adjusting screw 220, having a hexagonal central hole 221, is screwed into the threaded portion of bore 210. Circular disc-shaped spacer 230 having central hole 231 is disposed between the inner end of drive shaft 26 and adjusting screw 220. Axial movement of adjusting screw 220 is transferred to drive shaft 26 through spacer 230 so that all three elements move axially within bore 210. The construction and functional manner of adjusting screw 220 and spacer 230 are described in detail in U.S. Pat. No. 4,948,343 to Shimizu, the disclosure of which is hereby incorporated by reference.

Cam rotor 40 is fixed on drive shaft 26 by pin member 261 and rotates therewith. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is disposed adjacent cam rotor 40 and includes opening 53 through which drive shaft 26 passes. Slant plate 50 includes arm 51 having slot 52. Cam rotor 40 and slant plate 50 are coupled by pin member 42 which is inserted in slot 52 to form a hinged joint. Pin member 42 slides within slot 52 to allow adjustment of the slant angle of slant plate 50, that is, the angle of the surface of slant plate 50 with respect to a plane perpendicular to the longitudinal axis of drive shaft 26. Slant plate 50 slides along drive shaft 26 in the direction towards rear end plate 24 as it pivots away from its shown maximum slant angle (in the direction of arrow "a" in FIG. 4). Thus, the pivot center of slant plate 50 is shifted to the right along drive shaft 26 during pivoting from the maximum slant angle to a smaller slant angle.

Wobble plate 60 is mounted on slant plate 50 through bearings 61 and 62 such that slant plate 50 may rotate with respect thereto. Fork shaped slider 63 is attached to the outer peripheral end of wobble plate 60 and is slidably mounted on sliding rail 64 disposed between front end plate 23 and cylinder block 21. Fork shaped slider 63 prevents rotation of wobble plate 60. Wobble plate 60 nutates along rail 64 when cam rotor 40 and slant plate 50 rotate. Cylinder block 21 includes a plurality of peripherally located cylinder chambers 70 in which pistons 71 reciprocate. Each piston 71 is coupled to wobble plate 60 by a corresponding connecting rod 72.

Rear end plate 24 includes peripherally positioned annular suction chamber 241 and centrally positioned discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,011,029 to Shimizu, the disclosure of which is hereby incorporated by reference.

Suction chamber 241 includes inlet portion **241*a* which is connected to an evaporator of an external cooling circuit (not shown). Discharge chamber 251 is provided with outlet portion 251*a* which is connected to a condenser of the cooling circuit (not shown). Gaskets 27 and 28 are positioned between cylinder block 21 and the inner surface of valve plate 25 and the outer surface of valve plate 25 and rear end plate 24, respectively. Gaskets 27 and 28 seal the mating surface of cylinder block 21, valve plate 25 and rear end plate 24. Gaskets 27 and 28 and valve plate 25 thus form valve plate assembly 200**.

Conduit 18 is axially bored through cylinder block 21 so as to link crank chamber 22 to discharge chamber 251 through hole 181 which is axially bored through valve plate assembly 200. A throttling device, such as orifice tube 182, is fixedly disposed within conduit 18. Filter member 183 is disposed in conduit 18 at the rear of orifice tube 182. Accordingly, a portion of the discharged refrigerant gas in discharge chamber 251 always flows into crank chamber 22 at a reduced pressure generated by orifice tube 182. The above-mentioned construction and functional manner are described in detail in Japanese Patent Application Publication No. 1-142277, the disclosure of which is hereby incorporated by reference.

Communication path 400 links crank chamber 22 and suction chamber 241 and includes central bore 210 and passageway 150. Valve control mechanism 19 controls the opening and closing of communication path 400 in order to vary the capacity of the compressor.

During operation of compressor 10, drive shaft 26 is rotated by the engine of the vehicle (not shown) through electromagnetic clutch 300. Cam rotor 40 rotates with drive shaft 26, causing slant plate 50 to rotate as well. The rotation of slant plate 50 causes wobble plate 60 to nutate. The nutating motion of wobble plate 60 reciprocates pistons 71 in their respective cylinders 70. As pistons 71 are reciprocated, refrigerant gas, introduced into suction chamber 241 through inlet portion **241*a*, is drawn into cylinders 70 through suction ports 242 and subsequently compressed. The compressed refrigerant gas is discharged from cylinders 70 into discharge chamber 251 through respective discharge ports 252 and then into the cooling circuit through outlet portion 251*a***.

Some of the partially compressed refrigerant gas in cylinders 70 is blown into crank chamber 22 from cylinders 70 through gaps between respective pistons 71 and cylinders 70 during the compression stroke of pistons 71. This gas is known as blow-by gas. In addition, a portion of the discharged refrigerant gas in discharge chamber 251 always flows into crank chamber 22 with a reduced pressure generated by orifice tube 182. Valve control mechanism 19 includes bellows **19*a* which expands or contracts in response to the crank chamber pressure. When the pressure in crank chamber 22 exceeds a predetermined value, which is determined by appropriately designing valve control mechanism 19, communication path 400 is opened due to contraction of bellows 19*a* of valve control mechanism 19. Thereafter, crank chamber 22 is linked to suction chamber 241. Accordingly, the pressure in crank chamber 22 decreases to the pressure in suction chamber 241. However, if the pressure in crank chamber 22 decreases below the predetermined value, communication path 400 is blocked by expansion of bellows 19*a* of valve control mechanism 19 so that the communication between crank chamber 22 and suction chamber 241 is prevented. Accordingly, the pressure in crank chamber 22 gradually increases due to the partially compressed (blow-by) refrigerant gas from cylinders 70. Thus, the pressure level in crank chamber 22 is controlled by valve control mechanism 19**.

Figure 6:
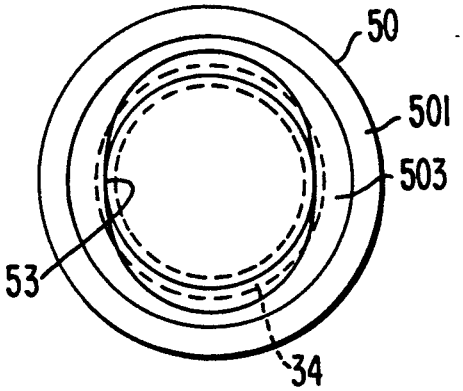
FIG. 6 illustrates an enlarged side view of a slant plate shown in FIG. 4.

With reference to FIGS. 5 and 6, a first embodiment of the present invention will be described in detail. The non-tensioned length of bias spring 34 when no force acts thereon is greater than the axial length of forward region 26a' of inner end portion 26a of drive shaft 26. Therefore, bias spring 34 is resiliently sandwiched between snap ring 33 and annular ridge 26c. The axial length of forward region 26a' of inner end portion 26a of drive shaft 26 is selected such that the left side of bias spring 34 does not contact any portion of the bottom surface of annular depression 503, so long as the slant angle of slant plate 50 is in a range between the maximum slant angle and a selected intermediate slant angle. However, if the slant angle of slant plate 50 decreases below the selected intermediate slant angle with a corresponding sliding of slant plate 50 to the right along drive shaft 26, the bottom surface of annular depression 503 contacts and compresses bias spring 34. Therefore, slant plate 50 is urged back toward its maximum slant angle by the restoring force of bias spring 34. The configuration and material of snap ring 33 are selected so as to sufficiently resist the reaction force generated by the compression of bias spring 34 by slant plate 50 when slant plate 50 assumes its minimum slant angle.

The radius of the body of bias spring 34 is designed to be generally equal to the height of annular ridge 26c. Therefore, the overall outer diameter of bias spring 34 is greater than the diameter of intermediate portion 26b of drive shaft 26 by the approximate length of the diameter of the body of bias spring 34. Accordingly, an outer half of the body of bias spring 34 protrudes from the outer periphery of intermediate portion 26b of drive shaft 26.

The assembly process of the first embodiment is as follows. Inner end portion 26a of drive shaft 26 is held adjacent to the left end of bias spring 34, and drive shaft 26 is inserted through bias spring 34 until the left end of bias spring 34 contacts annular ridge 26c of drive shaft 26. Snap ring 33 is firmly fixed in annular groove 26d while bias spring 34 is compressed so that bias spring 34 is resiliently sandwiched in between annular ridge 26c and snap ring 33.

In operation, the pressure in crank chamber 22 gradually increases due to the partially compressed (blow-by) refrigerant gas from cylinders 70. A change in the pressure in crank chamber 22 relative to suction chamber 24, generates a corresponding change in the slant angle of both slant plate 50 and wobble plate 60 so as to change the stroke length of pistons 71 in cylinders 70 and, thus, vary the displacement of compressor 10. If the slant angle of slant plate 50 decreases below the selected intermediate slant angle with a corresponding sliding of slant plate 50 to the right along drive shaft 26, slant plate 50 compresses spring 34. Thus slant plate 50 is urged back towards the maximum slant angle by the restoring force of bias spring 34.

As described above, in the present invention, the vacant space for disposing bias spring 34 around drive shaft 26 can be increased in comparison with the prior art by disposing bias spring 34 around forward region 26a' of inner end portion 26a which has a diameter smaller than the diameter of intermediate portion 26b. Therefore, even though an intermediate slant angle is selected that is smaller than prior art intermediate slant angles so that the magnitude of the impact forces generated when the compressor is started is reduced, slant plate 50 can still be sufficiently urged toward its maximum slant angle by the restoring force of bias spring 34 when the slant angle of slant plate 50 decreases below the selected intermediate slant angle. In addition, since bias spring 34 is initially compressed, slant plate 50 can be sufficiently urged back to its maximum slant angle at the initial contact between the left side of bias spring 34 and slant plate 50.

Furthermore, the decrease in the mechanical strength of hub 501 of slant plate 50 can be prevented because the pillared hollow portion as described in the prior art is not required to prevent the bias spring from interfering with the free pivoting motion of slant plate 50 between various inclination angles.

Figure 7:
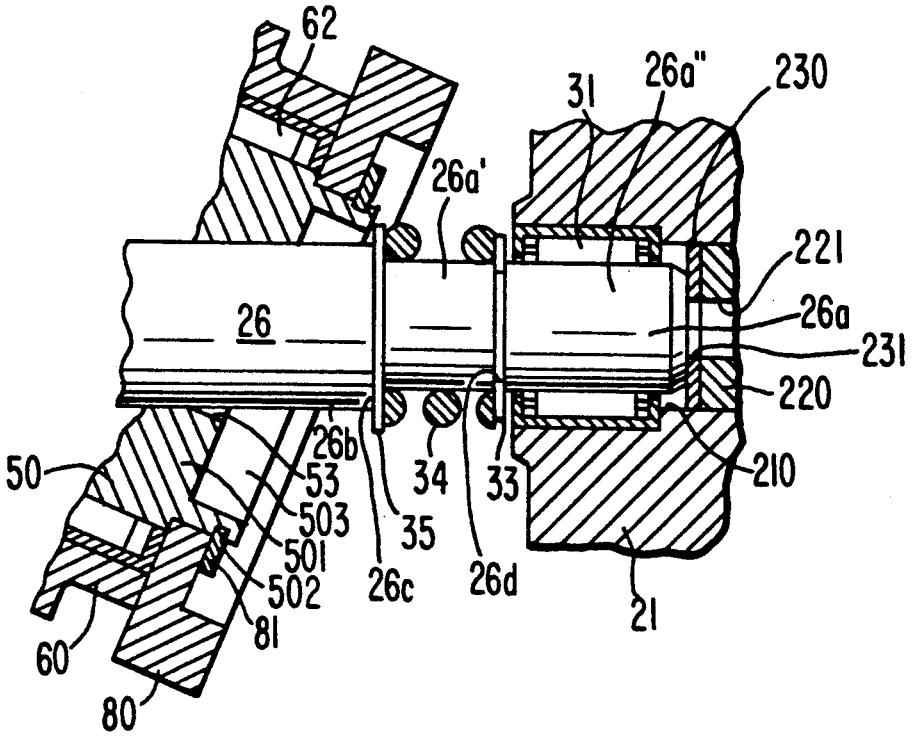
FIG. 7 illustrates an enlarged fragmentary longitudinal sectional view of a wobble plate type compressor in accordance with a second embodiment of the present invention.

With reference to FIG. 7, a second embodiment of this invention is shown. In FIG. 7, the same numerals are used to denote elements which are identical to the similarly numbered elements shown in FIG. 5 so that an explanation thereof is omitted. In this second embodiment, annular ring member 35 is disposed around forward region 26a' of inner end portion 26a of drive shaft 26 between annular ridge 26c and the left side of bias spring 34. An inner diameter of annular ring member 35 is slightly greater than the diameter of inner end portion 26a of drive shaft 26 so that annular ring member 35 may move axially along forward region 26a' of drive shaft 26. An outer diameter of annular ring member 35 is generally equal to the overall diameter of bias ring 34. Therefore, when the slant angle of slant plate 26 decreases below the selected intermediate slant angle and slant plate 50 slides to the right along drive shaft 50, the bottom surface of annular depression 503 compresses bias spring 34 through annular ring member 35. Accordingly, bias spring 34 is more effectively compressed by slant plate 50 when the slant angle of slant plate 50 decreases below the selected intermediate slant angle because of contact between the plain surfaces. In addition, the left side of bias spring 34 is more firmly received by annular ring member 35 is comparison with annular ridge 26c.

The assembling process of the second embodiment is as follows. Inner end portion 26a of drive shaft 26 is held adjacent to annular ring member 35 and the left end of bias spring 34. Drive shaft 26 is then inserted through annular ring member 35 and bias spring 34 until annular ring member 35 contacts annular ridge 26c of drive shaft 26. Snap ring 33 is then firmly fixed in annular groove 26d while bias spring 34 is compressed so that bias spring 34 is resiliently sandwiched in between annular ring member 35 and snap ring 33.

Figure 8:
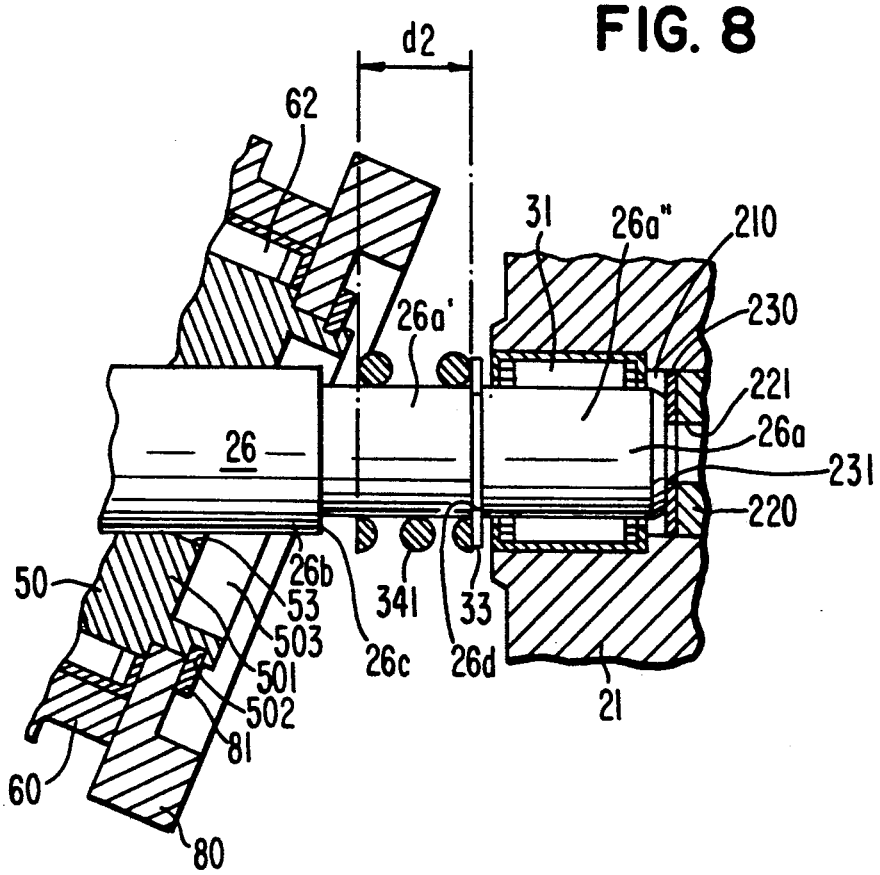
FIG. 8 illustrates an enlarged fragmentary longitudinal sectional view of a wobble plate type compressor in accordance with a third embodiment of the present invention.

With reference to FIG. 8, a third embodiment of this invention is shown. In FIG. 8, the same numerals are used to denote elements which are identical to similarly numbered elements shown in FIG. 5 so that explanation thereof is omitted. In this embodiment, bias spring 341 is disposed in an uncompressed state on inner portion 26a. Forward region 26a' of inner end portion 26a and annular ridge 26c are extended more towards slant plate 50 than in the previous embodiments. Bias spring 341 has a non-tensioned length "$d_2$" which is equal to the length "$d_1$" of forward region 26a' in FIG. 5. Thus, bias spring 341 in FIG. 8 will urge slant plate 50 towards its maximum slant angle after the slant angle of slant plate 50 decreases below the selected intermediate slant angle and slant plate 50 has shifted to the right along drive shaft 26. Bias spring 341 has an overall inside diameter along its right end that is slightly smaller than the diameter of inner end portion 26a, and the right end of bias spring 341 is located so as to be in contact with the left side surface of snap ring 33. Thus, bias spring 34 is prevented from axial movement along drive shaft 26.

This embodiment allows the overall diameter of the body of bias spring 341 to be larger than the diameter of the body of prior art springs because of the increased space created above smaller diameter inner end portion 26*a*. Additionally, slant plate 50 is urged toward its maximum slant angle without bias spring 341 interfering with hub 501 of slant plate 50 when slant plate 50 pivots between various inclination angles.

In the present invention, even though drive shaft 26 includes inner end portion 26*a* which has a diameter that is smaller than the diameter of intermediate portion 26*b* in order to allow bias spring 34 to be disposed around forward region 26*a'* of inner end portion 26*a*, the decrease in the mechanical strength of drive shaft 26 is negligible.

This invention has been described in connection with the preferred embodiments. These embodiments, however, are merely for example only and the invention is not restricted thereto. For example, the terms right and left are used merely for convenience of description, and the invention is not restricted in this manner. It will be understood by those skilled in the art that other variations and modifications of this invention can easily be made within the scope of this invention as defined by the claims.

We claim:

1. In a slant plate type compressor including a drive shaft and a slant plate disposed on said drive shaft, said slant plate moveable to various slant angles between a maximum and a minimum slant angle relative to a plane perpendicular to said drive shaft, said drive shaft including a first portion having a first diameter and a second portion having a second diameter, the improvement comprising:

a hub on said slant plate, said drive shaft extending through and in intimate contact with said hub;

a wobble plate nutatably mounted on said hub, and a bias spring having an overall outer diameter which is greater than the second diameter, said bias spring disposed only on said first portion of said drive shaft to restore said slant plate back to said maximum slant angle when said slant angle is decreased below a predetermined angle.

2. The compressor claimed in claim 1 wherein a non-tensioned length of said bias spring when no force acts thereon is larger than an axial length of said first portion of said drive shaft so that said bias spring is resiliently disposed on said first portion of said drive shaft.

3. The compressor claimed in claim 1 wherein a ring member is slidably disposed on said first portion of said drive shaft between one end of said bias spring and an annular ridge which is formed at the boundary between said first portion and said second portion of said drive shaft.

4. The compressor claimed in claim 3 wherein an outer diameter of said ring member is generally equal to said overall diameter of said bias spring.

5. A slant plate compressor comprising:

a housing;

a drive shaft supported in said housing, said drive shaft including a first portion having a first diameter and a second portion having a second greater diameter;

a slant plate disposed on said drive shaft, said slant plate moveable to various slant angles between a maximum and a minimum slant angle relative to a plane perpendicular to said drive shaft, said slant plate comprising a hub, said drive shaft extending through and in intimate contact with said hub;

a wobble plate nutatably mounted on said hub; and a spring disposed only on said first portion of said drive shaft, said spring serving to bias said slant plate towards said maximum angle.

6. The compressor claimed in claim 5, wherein said spring is in a compressed state when not in contact with said slant plate.

7. The compressor claimed in claim 5, wherein said spring biases said slant plate towards said maximum slant angle after said slant plate moves below an intermediate predetermined angle.

8. The compressor claimed in claim 5, wherein an overall outer diameter of said spring is greater than said second diameter of said second portion of said shaft and an overall inner diameter of said spring is greater than said first diameter of said first portion of said shaft and less than said second diameter.

9. The compressor claimed in claim 5, wherein:

said drive shaft has a ridge separating said first and second portions;

said spring has first and second ends; and said first end of said spring is adjacent said ridge.

10. The compressor claimed in claim 9, said shaft having a snap ring positioned thereupon, and said spring compressed between said ridge and said snap ring.

11. The compressor claimed in claim 9, wherein said first end of said spring and said ridge are separated by a ring member.

12. The compressor claimed in claim 11, wherein said ring member is slidable along said first portion of said drive shaft.

* * * * *